US011939900B1

(12) United States Patent
Martz et al.

(10) Patent No.: US 11,939,900 B1
(45) Date of Patent: Mar. 26, 2024

(54) SYSTEM AND METHOD FOR ENGINE COLD START

(71) Applicant: Ford Global Technologies, LLC, Dearborn, MI (US)

(72) Inventors: Jason Martz, Canton, MI (US); Michiel J. Van Nieuwstadt, Ann Arbor, MI (US); Eric Kurtz, Dearborn, MI (US); Paul Tennison, West Bloomfield, MI (US); Brien Lloyd Fulton, Bloomfield Hills, MI (US); Daniel Styles, Canton, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 18/295,440

(22) Filed: Apr. 4, 2023

(51) Int. Cl.
*F01N 3/08* (2006.01)
*F01N 3/20* (2006.01)
*F01N 13/00* (2010.01)

(52) U.S. Cl.
CPC ..... *F01N 3/0885* (2013.01); *F01N 3/0814* (2013.01); *F01N 3/0842* (2013.01); *F01N 3/2013* (2013.01); *F01N 3/2033* (2013.01); *F01N 13/011* (2014.06); *F01N 2240/14* (2013.01); *F01N 2240/16* (2013.01); *F01N 2240/18* (2013.01); *F01N 2250/12* (2013.01); *F01N 2900/08* (2013.01)

(58) Field of Classification Search
CPC .... F01N 3/0885; F01N 3/0814; F01N 3/0842; F01N 3/2013; F01N 3/2033; F01N 13/011; F01N 2240/14; F01N 2240/16; F01N 2240/18; F01N 2250/12; F01N 2900/08
See application file for complete search history.

(56) References Cited

U.S. PATENT DOCUMENTS

| | | | | |
|---|---|---|---|---|
| 7,861,517 | B2 | 1/2011 | Goulette et al. | |
| 10,450,925 | B2 | 10/2019 | Sakuma | |
| 10,480,369 | B1 | 11/2019 | Dahodwala et al. | |
| 11,466,633 | B1 | 10/2022 | Martz et al. | |
| 11,519,313 | B1 | 12/2022 | Martz et al. | |
| 2009/0173064 | A1* | 7/2009 | Ren | F01N 3/0821 60/299 |
| 2015/0184567 | A1 | 7/2015 | Yamashita et al. | |
| 2019/0232948 | A1* | 8/2019 | Nawata | B60K 6/445 |
| 2019/0292964 | A1* | 9/2019 | Laube | F01N 13/14 |
| 2020/0131981 | A1* | 4/2020 | Buerkle | F02D 41/0245 |
| 2020/0291839 | A1* | 9/2020 | Lambert | F01N 3/0807 |
| 2022/0268193 | A1* | 8/2022 | Punde | F01N 3/106 |
| 2023/0203978 | A1* | 6/2023 | Koo | F01N 3/2013 60/273 |

FOREIGN PATENT DOCUMENTS

EP 1884631 A2 2/2008

* cited by examiner

*Primary Examiner* — Brandon D Lee
(74) *Attorney, Agent, or Firm* — Vincent Mastrogiacomo; McCoy Russell LLP

(57) ABSTRACT

Methods and systems for reducing emissions of an internal combustion engine are described. In one example, an electric heater and a passive NOx absorber or other emissions control device are positioned in a passage downstream of a combustor so as to process emissions from the combustor before an engine is started.

15 Claims, 7 Drawing Sheets

SYSTEM AND METHOD FOR ENGINE COLD START

BACKGROUND/SUMMARY

Exhaust of an engine may be processed via one or more after treatment devices such as an oxidation catalyst, selective reduction catalyst, and diesel particulate filter to lower engine emissions. However, the after treatment devices may not perform well when the engine is cold started because the after treatment devices are not operating at their desired operating temperatures. In particular, the after treatment devices may not process hydrocarbons, CO, and NOx as efficiently as may be desired. Therefore, it may be desirable to provide a way of improving after treatment efficiency during an engine cold start and during conditions when engine output heat is low.

The inventors herein have recognized the above-mentioned disadvantages and have developed an exhaust system for an internal combustion engine, comprising: an air pump supplying air to a combustor located along a first passage; a three-way valve positioned downstream of the combustor along the first passage; an electric heater positioned along a second passage downstream of the three-way valve; and a third passage arranged in parallel with the second passage the third passage coupled to the second passage and entering a fourth passage; the fourth passage extending to an exhaust passage and positioned upstream of a group of after treatment devices in the exhaust passage.

By arranging an electric heater downstream of a combustor, it may be possible to provide the technical result of increasing efficiency of one or more after treatment devices during an engine cold start and lowering tailpipe emissions. In particular, the electric heater may be activated before the combustor is activated and before an engine is activated so that when exhaust byproducts exit the combustor they may be processed by one or more after treatment devices that have been heated up to or near their operating temperature via the electric heater. In one example, where the one or more after treatment devices may include a passive NOx absorber, the electric heater may control the temperature of the passive NOx absorber such that hydrocarbons and CO are oxidized without releasing NOx from the passive NOx absorber.

The present description may provide several advantages. In particular, the approach may lower tailpipe emissions. In addition, the approach may be implemented by applying different catalyst formulations so that system cost may meet expectations. Further, the approach may be applied before an engine is operating to lower tailpipe emissions when the engine is eventually started.

The above advantages and other advantages, and features of the present description will be readily apparent from the following Detailed Description when taken alone or in connection with the accompanying drawings.

It is to be understood that the summary above is provided to introduce in simplified form a selection of concepts that are further described in the detailed description. It is not meant to identify key or essential features of the claimed subject matter, the scope of which is defined uniquely by the claims that follow the detailed description. Furthermore, the claimed subject matter is not limited to implementations that solve any disadvantages noted above or in any part of this disclosure.

DETAILED DESCRIPTION

Figure 1:
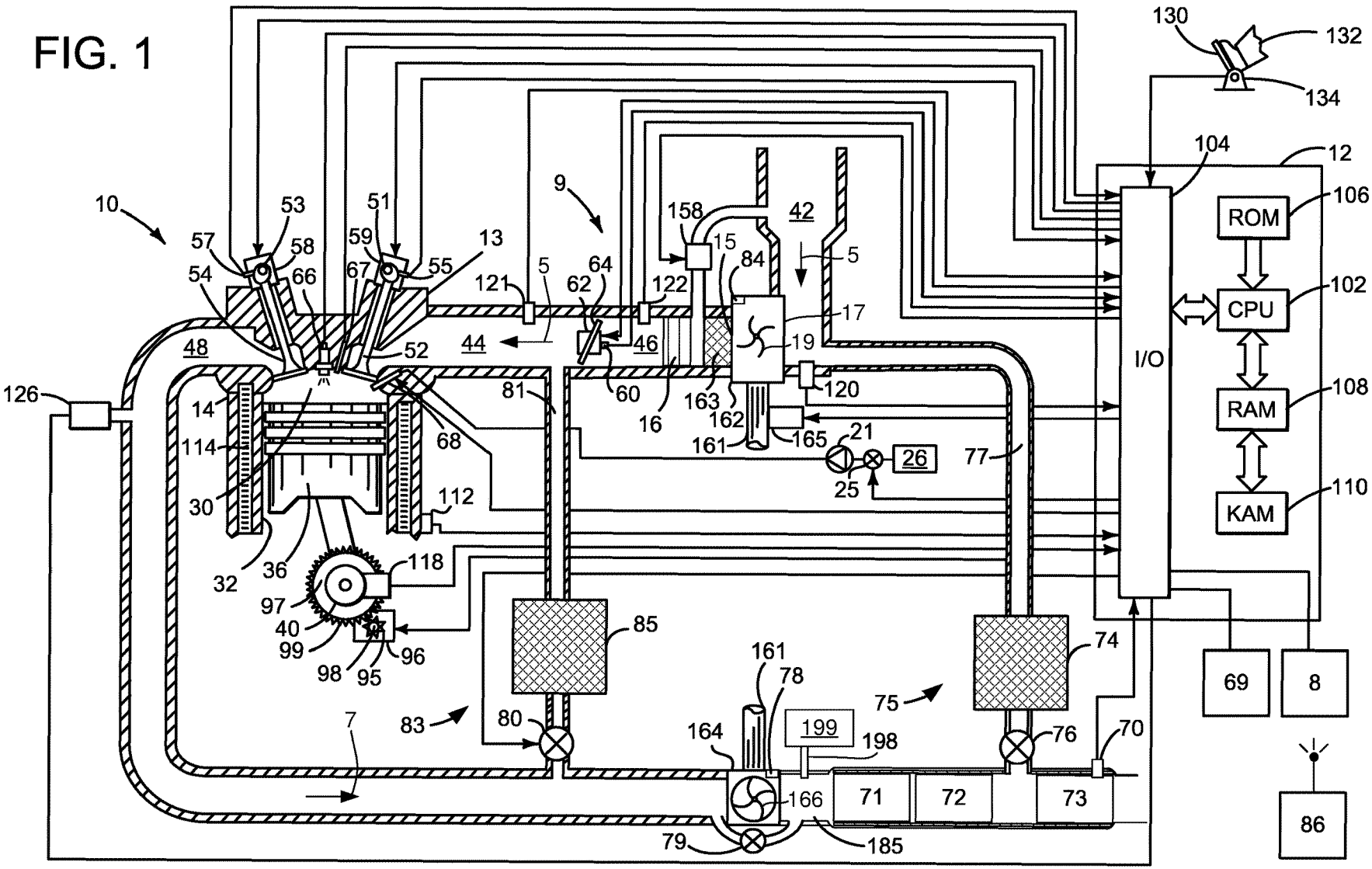
FIG. 1 shows a detailed schematic depiction of an example engine.
Figure 2:
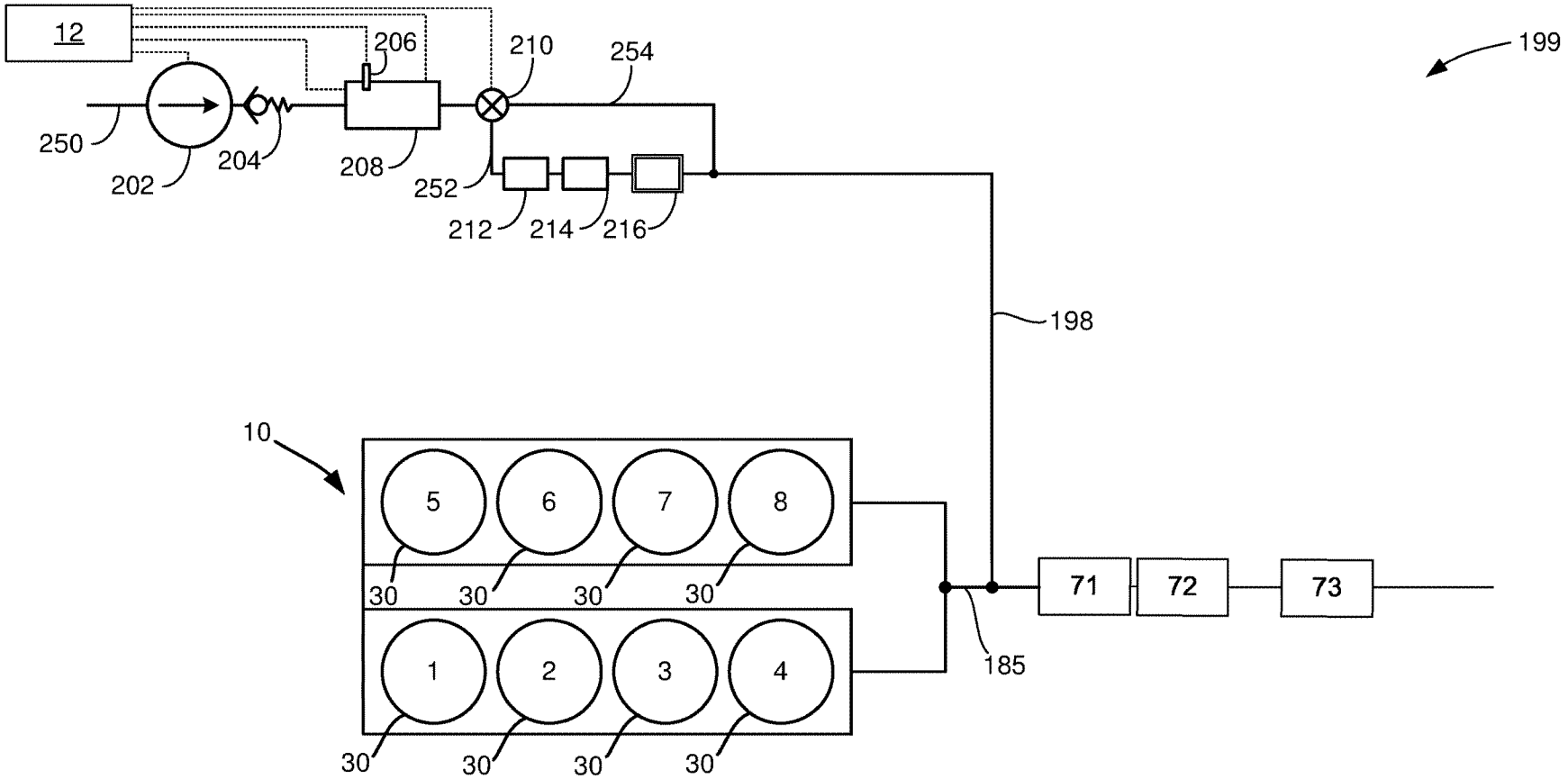
FIGS. 2-4 show schematic views of example exhaust system configurations for the example engine of FIG. 1.
Figure 3:
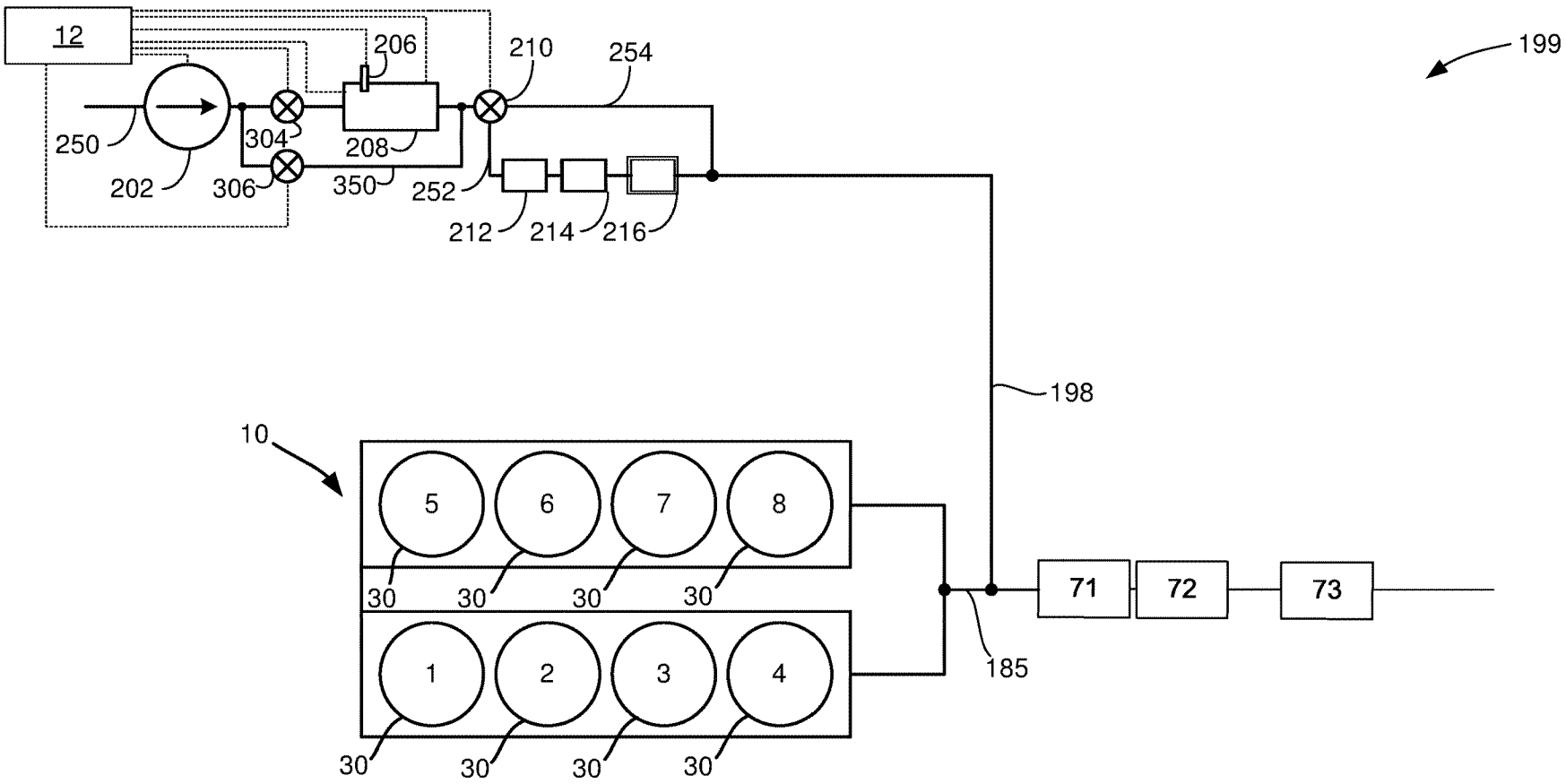
Figure 4:
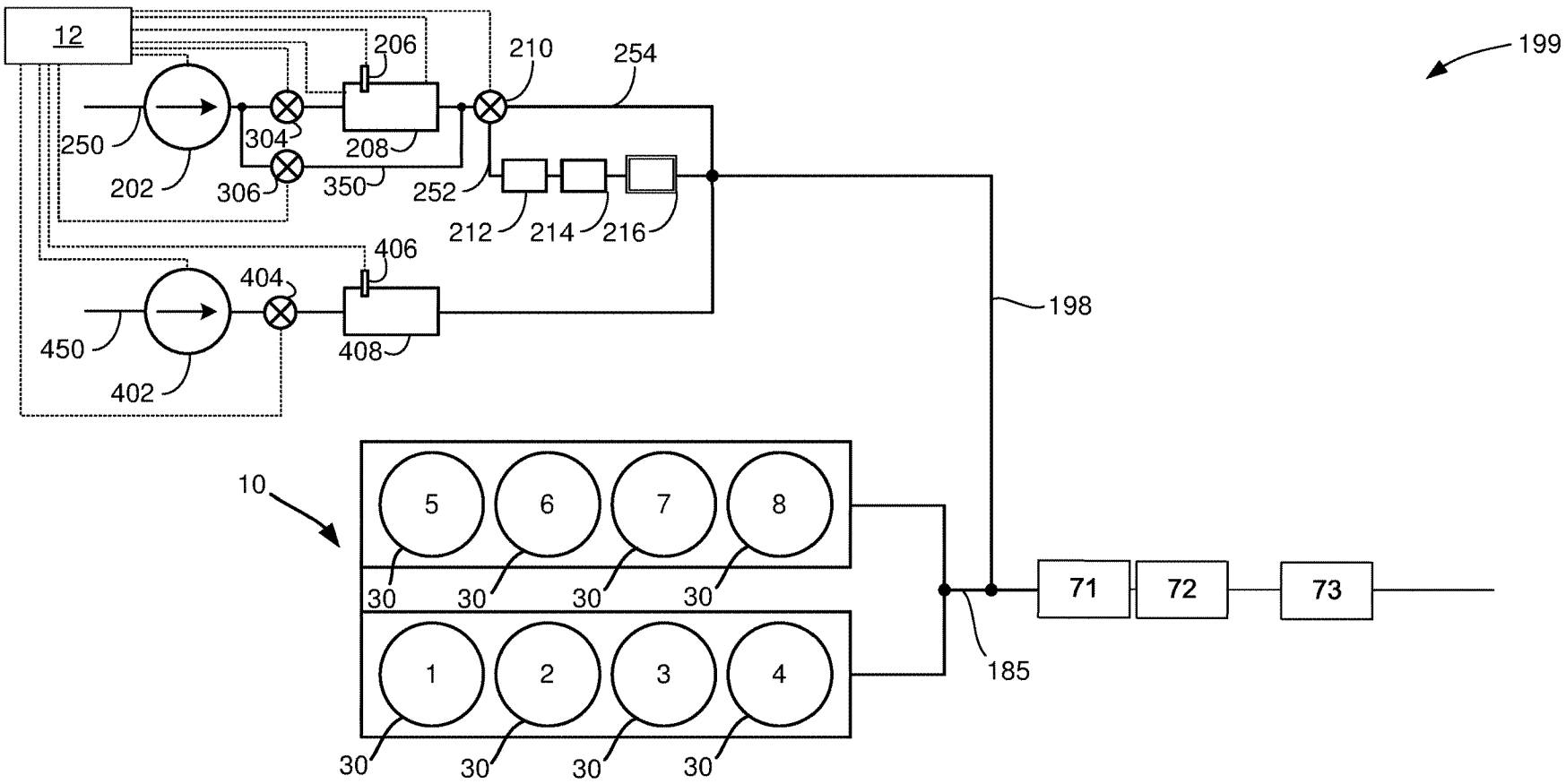
Figure 5:
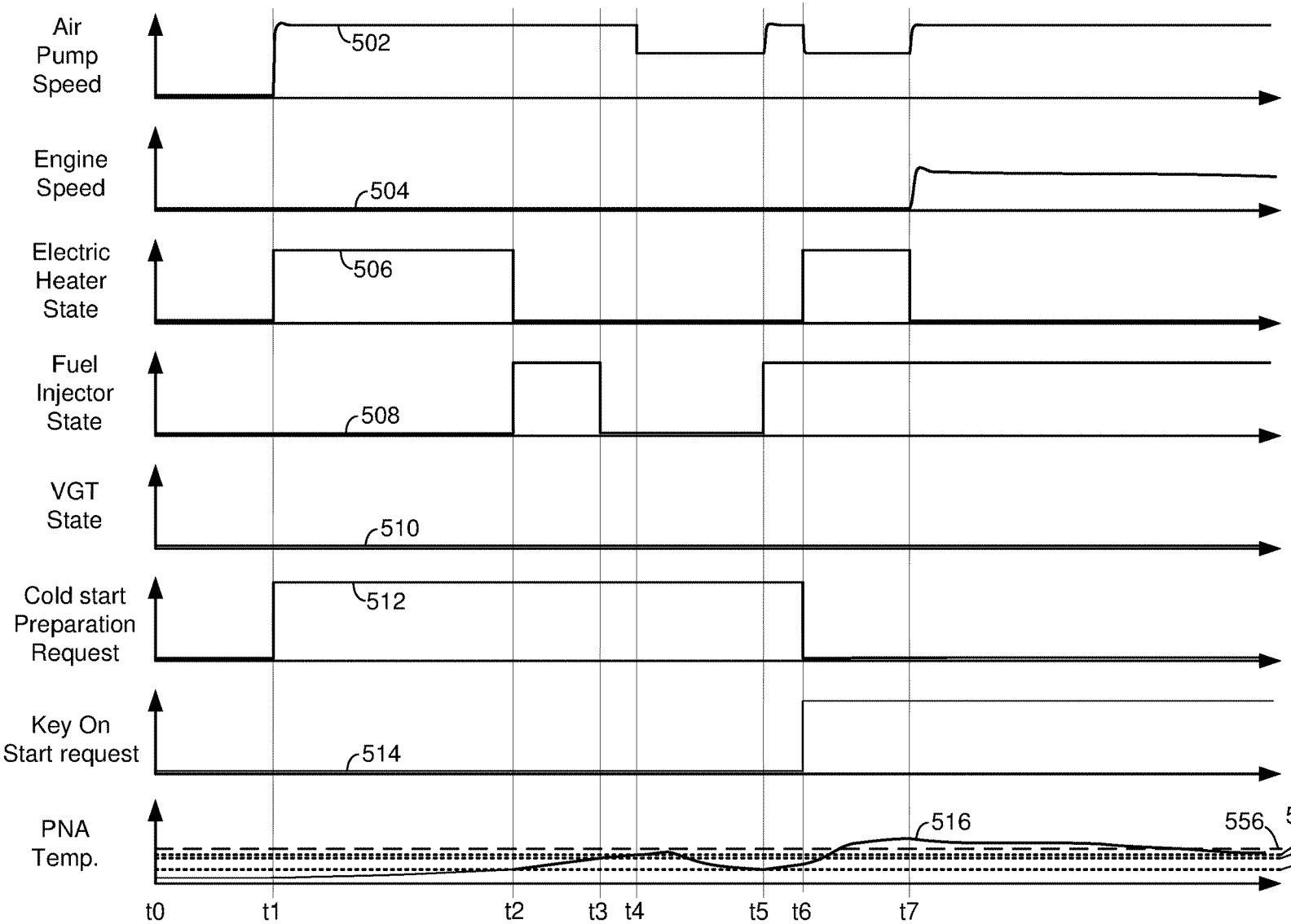
FIG. 5 shows an example operating sequence according to the FIG. 6 and the system of FIGS. 1-4.
Figure 6:
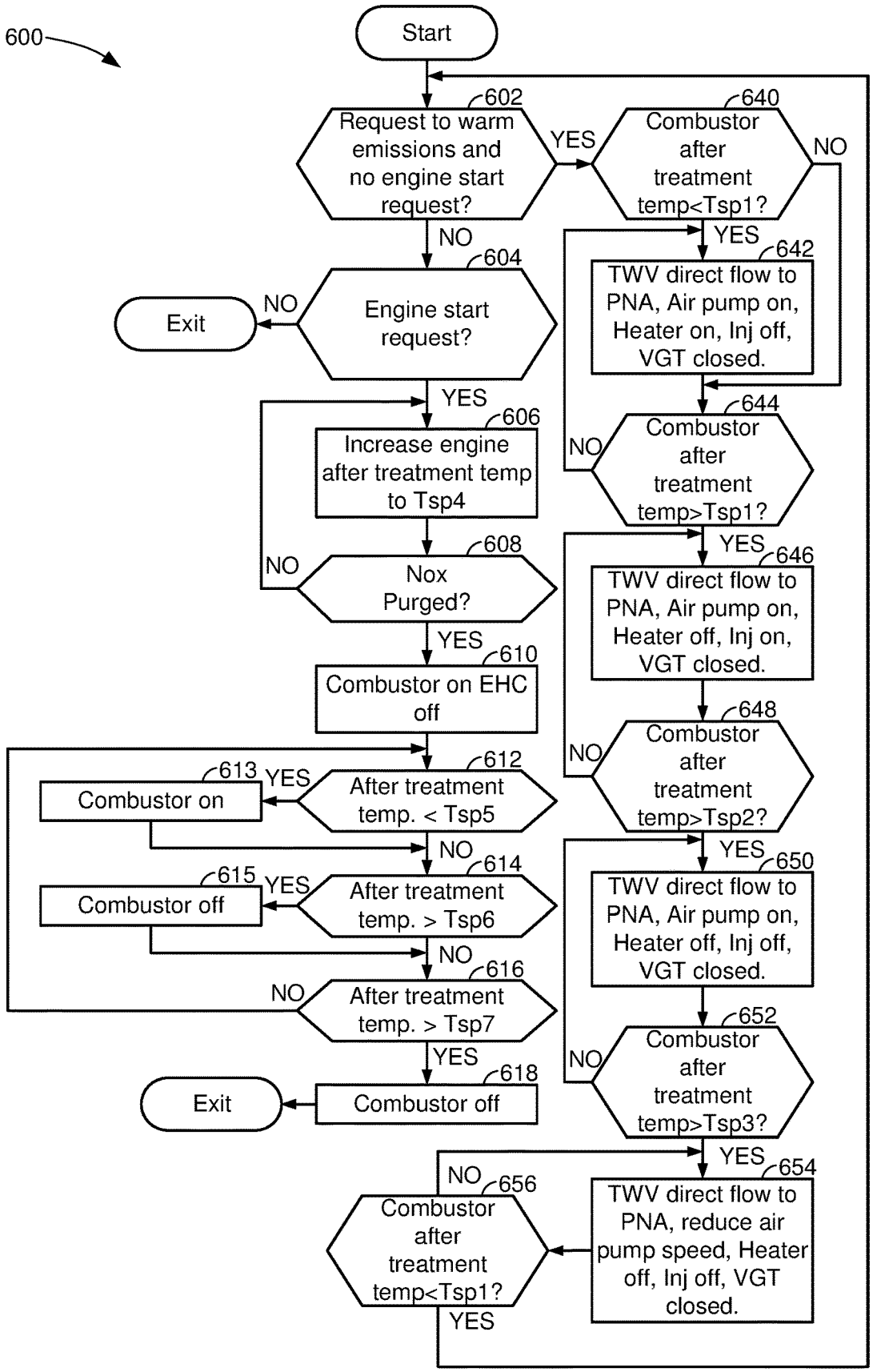
FIG. 6 shows a flowchart of a method for operating an engine and a single combustor.
Figure 7:
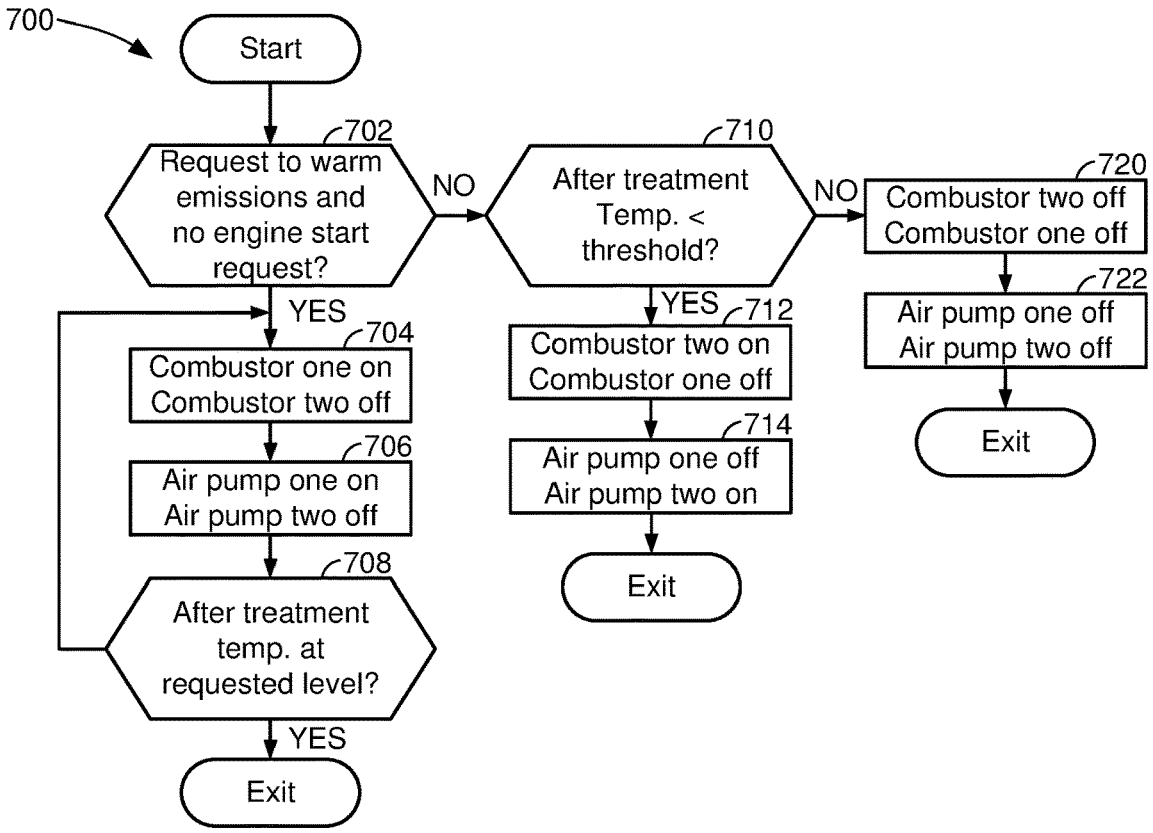
FIG. 7 shows a flowchart of a method for operating an engine and two combustors.

The present description is related to operating an engine and exhaust system after treatment devices before and during a cold engine start as well as during operating conditions when heat output of the engine is low. An example engine is shown in FIG. 1. Example exhaust systems for the engine of FIG. 1 are shown in FIGS. 2-4. An example operating sequence according to the method of FIG. 6 and the systems of FIGS. 2-4 is shown in FIG. 5. A method for operating the engine is shown in FIGS. 6 and 7.

Referring to FIG. 1, internal combustion engine 10, comprising a plurality of cylinders, one cylinder of which is shown in FIG. 1, is controlled by electronic engine controller 12. The controller 12 receives signals from the various sensors of FIG. 1 and employs the various actuators of FIG. 1 to adjust engine operation based on the received signals and instructions stored on a memory of the controller.

Engine 10 includes combustion chamber 30 and cylinder walls 32 with piston 36 positioned therein and connected to crankshaft 40. Cylinder head 13 is fastened to engine block 14. Combustion chamber 30 is shown communicating with intake manifold 44 and exhaust manifold 48 via respective intake valve 52 and exhaust valve 54. Each intake and exhaust valve may be operated by an intake cam 51 and an exhaust cam 53. Although in other examples, the engine may operate valves via a single camshaft or pushrods. The position of intake cam 51 may be determined by intake cam sensor 55. The position of exhaust cam 53 may be determined by exhaust cam sensor 57. Intake poppet valve 52 may be operated by a variable valve activating/deactivating actuator 59. Likewise, exhaust poppet valve 54 may be operated by a variable valve activating/deactivating actuator 58. Intake poppet valve 52 and exhaust poppet valve 54 may be deactivated and held in a closed position preventing flow into and out of cylinder 30 for one or more entire engine cycles (e.g. two engine revolutions), thereby deactivating cylinder 30. Flow of fuel supplied to cylinder 30 may also cease when cylinder 30 is deactivated.

Fuel injector 68 is shown positioned in cylinder head 13 to inject fuel directly into combustion chamber 30, which is known to those skilled in the art as direct injection. Fuel is delivered to fuel injector 68 by a fuel system including a fuel tank 26, low pressure fuel pump (not shown), high pressure fuel pump 21, fuel pump volume control valve 25, and fuel rail (not shown).

Engine air intake system 9 includes intake manifold 44, throttle 62, grid heater 16, charge air cooler 163, turbocharger compressor 162, and intake plenum 42. Intake manifold 44 is shown communicating with optional electronic throttle 62 which adjusts a position of throttle plate 64 to control air flow from intake boost chamber 46. Compressor 162 draws air from air intake plenum 42 to supply boost chamber 46. Compressor vane actuator 84 adjusts a position of compressor vanes 19. Exhaust gases spin turbine 164 which is coupled to turbocharger compressor 162 via shaft 161. In some examples, a charge air cooler 163 may be provided. Further, an optional grid heater 16 may be provided to warm air entering cylinder 30 when engine 10 is being cold started. Compressor speed may be adjusted via adjusting a position of turbine variable vane control actuator 78 or compressor recirculation valve 158. In alternative examples, a waste gate 79 may replace or be used in addition to turbine variable vane control actuator 78. Turbine variable vane control actuator 78 adjusts a position of variable geometry turbine vanes 166. Exhaust gases can pass through turbine 164 supplying little energy to rotate turbine 164 when vanes are in an open position. Exhaust gases can pass through turbine 164 and impart increased force on turbine 164 when vanes 166 are in a closed position. Alternatively, waste gate 79 or a bypass valve may allow exhaust gases to flow around turbine 164 so as to reduce the amount of energy supplied to the turbine. Compressor recirculation valve 158 allows compressed air at the outlet 15 of compressor 162 to be returned to the inlet 17 of compressor 162. Alternatively, a position of turbine variable vane control actuator 78 may be adjusted to change the efficiency of compressor 162. In this way, the efficiency of compressor 162 may be reduced so as to affect the flow of compressor 162 and reduce the possibility of compressor surge. Further, by returning air back to the inlet 17 of compressor 162, work performed on the air may be increased, thereby increasing the temperature of the air. Optional electric machine 165 is also shown coupled to shaft 161. Optional electric machine 165 may rotate compressor 162 when engine 10 is not rotating, when engine 10 is rotating at low speed (e.g., cranking speed such as 250 RPM), or when exhaust energy is low to provide additional boost. Air flows into engine 10 in the direction of arrows 5.

Flywheel 97 and ring gear 99 are coupled to crankshaft 40. Starter 96 (e.g., low voltage (operated with less than 30 volts) electric machine) includes pinion shaft 98 and pinion gear 95. Pinion shaft 98 may selectively advance pinion gear 95 to engage ring gear 99 such that starter 96 may rotate crankshaft 40 during engine cranking. Starter 96 may be directly mounted to the front of the engine or the rear of the engine. In some examples, starter 96 may selectively supply torque to crankshaft 40 via a band or chain. In one example, starter 96 is in a base state when not engaged to the engine crankshaft. An engine start/stop may be requested via human/machine interface (e.g., key switch, pushbutton, remote radio frequency emitting device, etc.) 69 or in response to vehicle operating conditions (e.g., brake pedal position, accelerator pedal position, battery SOC, etc.). Battery 8 may supply electrical power to starter 96 and electric machine 165. Controller 12 may monitor battery state of charge.

Combustion is initiated in the combustion chamber 30 when fuel automatically ignites via combustion chamber temperatures reaching the auto-ignition temperature of the fuel that is injected to cylinder 30. The temperature in the cylinder increases as piston 36 approaches top-dead-center compression stroke. In some examples, a universal Exhaust Gas Oxygen (UEGO) sensor 126 may be coupled to exhaust manifold 48 upstream of after treatment device 71. In other examples, the UEGO sensor may be located downstream of one or more exhaust after treatment devices. Further, in some examples, the UEGO sensor may be replaced by a NOx sensor that has both NOx and oxygen sensing elements.

At lower engine temperatures optional glow plug 66 may convert electrical energy into thermal energy so as to create a hot spot next to one of the fuel spray cones of an injector in the combustion chamber 30. By creating the hot spot in the combustion chamber 30 next to sprayed fuel, it may be easier to ignite the fuel spray plume in the cylinder, releasing heat that propagates throughout the cylinder, raising the temperature in the combustion chamber, and improving combustion. Cylinder pressure may be measured via optional pressure sensor 67, alternatively or in addition, sensor 67 may also sense cylinder temperature.

After treatment device 71 can include an oxidation catalyst and it may be followed by a diesel particulate filter (DPF) 72 and a selective catalytic reduction (SCR) catalyst 73, in one example. In another example, DPF 72 may be positioned downstream of SCR catalyst 73. Temperature sensor 70 provides an indication of SCR temperature. Exhaust flows in the direction of arrow 7. A combustor system 199 may supply heated air to after treatment devices via passage or conduit 198 upstream of after treatment devices 71-73 and downstream of turbine 164. Passage or conduit 198 may merge into exhaust passage or conduit 185.

Exhaust gas recirculation (EGR) may be provided to the engine via high pressure EGR system 83. High pressure EGR system 83 includes EGR valve 80, EGR passage 81, and EGR cooler 85. EGR valve 80 is a valve that closes or allows exhaust gas to flow from upstream of after treatment device 71 to a location in the engine air intake system downstream of compressor 162. EGR may be cooled via passing through EGR cooler 85. EGR may also be provided via low pressure EGR system 75. Low pressure EGR system 75 includes EGR passage 77 and EGR valve 76. Low pressure EGR may flow from downstream of after treatment device 71 to a location upstream of compressor 162. Low pressure EGR system 75 may include an EGR cooler 74.

Controller 12 is shown in FIG. 1 as a conventional microcomputer including: microprocessor unit 102, input/output ports 104, read-only memory (e.g., non-transitory memory) 106, random access memory 108, keep alive memory 110, and a conventional data bus. Controller 12 is shown receiving various signals from sensors coupled to engine 10, in addition to those signals previously discussed, including: engine coolant temperature (ECT) from temperature sensor 112 coupled to cooling sleeve 114; a position sensor 134 coupled to a driver demand pedal 130 for sensing driver demand pedal position adjusted by human foot 132; a measurement of engine manifold pressure (MAP) from pressure sensor 121 coupled to intake manifold 44 (alternatively or in addition pressure sensor 121 may sense intake manifold temperature); boost pressure from pressure sensor 122 exhaust gas oxygen concentration from oxygen sensor 126; an engine position sensor from an engine position sensor 118 sensing crankshaft 40 position; a measurement of air mass entering the engine from sensor 120 (e.g., a hot wire air flow meter); and a measurement of throttle position from sensor 60. Barometric pressure may also be sensed (sensor not shown) for processing by controller 12. In a preferred aspect of the present description, engine position sensor 118 produces a predetermined number of equally spaced pulses each revolution of the crankshaft from which engine speed (RPM) can be determined.

Controller 12 may receive data and requests from a remote device 86 that is external to the vehicle that the controller and engine are a part of. Remote device 86 may be a key fob, server, phone, or other device. The requests may include an engine cold start preparation request, engine start request, and so on.

During operation, each cylinder within engine 10 typically undergoes a four-stroke cycle: the cycle includes the intake stroke, compression stroke, expansion stroke, and exhaust stroke. During the intake stroke, generally, the exhaust valve 54 closes and intake valve 52 opens. Air is introduced into combustion chamber 30 via intake manifold 44, and piston 36 moves to the bottom of the cylinder so as to increase the volume within combustion chamber 30. The position at which piston 36 is near the bottom of the cylinder and at the end of its stroke (e.g. when combustion chamber 30 is at its largest volume) is typically referred to by those of skill in the art as bottom dead center (BDC). During the compression stroke, intake valve 52 and exhaust valve 54 are closed. Piston 36 moves toward the cylinder head so as to compress the air within combustion chamber 30. The point at which piston 36 is at the end of its stroke and closest to the cylinder head (e.g. when combustion chamber 30 is at its smallest volume) is typically referred to by those of skill in the art as top dead center (TDC). In a process hereinafter referred to as injection, fuel is introduced into the combustion chamber. In some examples, fuel may be injected to a cylinder a plurality of times during a single cylinder cycle.

In a process hereinafter referred to as ignition, the injected fuel is ignited by compression ignition resulting in combustion. During the expansion stroke, the expanding gases push piston 36 back to BDC. Crankshaft 40 converts piston movement into a rotational torque of the rotary shaft. Finally, during the exhaust stroke, the exhaust valve 54 opens to release the combusted air-fuel mixture to exhaust manifold 48 and the piston returns to TDC. Note that the above is described merely as an example, and that intake and exhaust valve opening and/or closing timings may vary, such as to provide positive or negative valve overlap, late intake valve closing, or various other examples. Further, in some examples a two-stroke cycle may be used rather than a four-stroke cycle.

Referring now to FIG. 2, a detailed schematic view of combustor system 199 is shown. Electrical connections are shown via dashed lines and components are shown via solid lines. Combustor system 199 may supply heated air and/or combustion gases to heat downstream after treatment devices 71-73. Controller 12 may adjust operating states of valves, injectors, pumps, and combustors to operate the combustor system 199.

Combustor system includes an air pump 202 that supplied fresh air to combustor 208 via check valve 204, which is located along passage or conduit 250. Fuel injector 206 may provide fuel to combustor 208 for mixing with air that may be supplied via air pump 202. Air or a combination of air and combustion gases may be delivered to three-way valve 210. Three-way valve 210 may deliver the air and combustion gases to passage or conduit 252. Alternatively, three-way valve 210 may deliver the air and combustion gases to passage or conduit 254. Passage or conduit 254 may be referred to as a bypass passage or conduit. Electric heater 212, first after treatment device 214 (e.g., a diesel oxidation catalyst, passive NOx trap, or three-way catalyst), and optional second after treatment device 216 (e.g., a lean NOx trap or a selective reduction catalyst (SCR)) are located along passage or conduit 252. After treatment devices 214 and 216 may be referred to combustor after treatment devices since they are configured to process combustor gases whereas after treatment devices 71-73 may be referred to as engine after treatment devices since they are substantially configured to process engine exhaust gases. Passage or conduit 252 and passage or conduit 254 combine or merge into passage or conduit 198 before entering exhaust passage or conduit 185. Passage 252 may be provided to reduce a possibility of catalyst degradation when combustor 208 is operating under high power/warm exhaust conditions.

Referring now to FIG. 3, a detailed schematic view of combustor system 199 is shown. Electrical connections are shown via dashed lines and components are shown via solid lines. Combustor system 199 may supply heated air and/or combustion gases to heat downstream after treatment devices 71-73. Controller 12 may adjust operating states of valves, injectors, pumps, and combustors to operate the combustor system 199.

The combustor system of FIG. 3 includes many of the same components as the combustor system that is shown in FIG. 3. Further, the components of FIG. 3 that are equivalent to the components of FIG. 2 are labeled with the same numbers as in FIG. 2. For example, air pump 202 in FIG. 2 is the same air pump 202 in FIG. 3. Therefore, for the sake of brevity, the description of similar components in FIG. 3 is omitted.

FIG. 3 includes a passage or conduit 350 that is arranged in parallel with passage or conduit 250. The passage or conduit 350 allows fresh air to be mixed with output gases of combustor 208. Thus, passage or conduit 350 allows dilution and cooling of gas that exit combustor 208. FIG. 3 also includes combustor flow control valve 304 and bypass flow control valve 306. These valves may be cycled open and closed (e.g., modulated) to control air flow into combustor 208 and dilution/cooling of gases exiting combustor 208 before the gasses flow through three-way valve 210.

The combustor system of FIG. 3 offers the advantage of adjusting a temperature of gases entering three-way valve 210 via controlling mixing of fresh air flow from air pump 202 with combustion gases that are exiting combustor 208 as compared to the combustor system of FIG. 3. This may be beneficial to control a temperature of after treatment devices 214 and 216 when combustor 208 is operational.

Turning now to FIG. 4, a detailed schematic view of combustor system 199 is shown. Electrical connections are shown via dashed lines and components are shown via solid lines. Combustor system 199 may supply heated air and/or combustion gases to heat downstream after treatment devices 71-73. Controller 12 may adjust operating states of valves, injectors, pumps, and combustors to operate the combustor system 199.

The combustor system of FIG. 4 includes many of the same components as the combustor system that is shown in FIGS. 2 and 3. Further, the components of FIG. 4 that are equivalent to the components of FIGS. 2 and 3 are labeled with the same numbers as in FIGS. 2 and 3. For example, air pump 202 in FIG. 2 is the same air pump 202 in FIG. 4. Therefore, for the sake of brevity, the description of similar components in FIG. 4 is omitted.

The combustor system of FIG. 4 includes a second air pump 402 and a second combustor 408 that are located along passage or conduit 450. Air flow from the second air pump 402 to the second combustor 408 may be controlled via flow control valve 404. Fuel may be injected into second combustor 408 via second fuel injector 406. Passage or conduit 450 joins with passages or conduits 252 and 254 into passage or conduit 198.

The combustor system of FIG. 4 offers the advantage of higher temperatures of gases entering after treatment devices 71-73. This may be beneficial to lower an amount of time that it takes for after treatment devices 71-73 to reach an operating temperature (e.g., a light-off temperature).

Thus the systems of FIGS. 1-4 provide for an exhaust system for an internal combustion engine, comprising: an air pump supplying air to a combustor located along a first passage; a three-way valve positioned downstream of the combustor along the first passage; an electric heater positioned along a second passage downstream of the three-way valve; and a third passage arranged in parallel with the second passage the third passage coupled to the second passage and entering a fourth passage; the fourth passage extending to an exhaust passage and positioned upstream of a group of after treatment devices in the exhaust passage. In a first example, the exhaust system includes where the fourth passage is coupled to the exhaust passage downstream of a turbocharger. In a second example that may include the first example, the exhaust system further comprises a check valve positioned along the first passage and an oxidation catalyst located along the second passage downstream of the electric heater. In a third example that may include one or both of the first and second examples, the exhaust system includes where the check valve is configured to allow flow from the air pump to the combustor and prevent flow from the combustor to the air pump. In a fourth example that may include one or more of the first through third examples, the exhaust system further comprises a passive NOx absorber located along the second passage downstream of the electric heater. In a fifth example that may include one or more of the first through fourth examples, the exhaust system includes where the fourth passage extends to the exhaust passage at a location downstream of a turbocharger turbine. In a sixth example that may include one or more of the first through fifth examples, the exhaust system further comprises a variable geometry turbocharger and a controller, the controller including executable instructions stored in non-transitory memory that cause the controller to activate the air pump, activate the electric heater, and adjust an operating state of the three-way valve. In a seventh example that may include one or more of the first through sixth examples, the exhaust system further comprises executable instructions that cause the controller to: activate the air pump, fully close the variable geometry turbocharger, and activate the electric heater in response to an engine cold start preparation request while rotational speed of the internal combustion engine is zero.

The system of FIGS. 1-4 also provides for an exhaust system for an internal combustion engine, comprising: an air pump supplying air to a combustor located along a first passage; a three-way valve positioned downstream of the combustor along the first passage; an electric heater positioned along a second passage downstream of the three-way valve; an oxidation catalyst and a lean NOx trap arranged alone the second passage; and a third passage arranged in parallel with the second passage the third passage coupled to the second passage and entering a fourth passage; the fourth passage extending to an exhaust passage and positioned upstream of a group of after treatment devices in the exhaust passage. In a first example, the exhaust system further comprises a bypass passage arranged in parallel with the first passage and in series with the second passage and the third passage. In a second example, the exhaust system further comprises a second combustor, the second combustor arranged in parallel with the first passage, second passage, and third passage. In a third example, the exhaust system further comprises a fuel injector configured to inject fuel to the combustor. In a fourth example, the exhaust system further comprising a second combustor arranged in parallel with the first combustor and a second fuel injector configured to inject fuel to the second combustor.

Referring now to FIG. 5, an example prophetic vehicle operating sequence for a system from FIGS. 1-4 that is operated according to the method of FIG. 6 is shown. The operating sequence of FIG. 5 may be produced via one of the system of FIGS. 1-4 and executing instructions of the method described in FIG. 6. The plots of FIG. 5 are aligned in time and occur at the same time. Vertical markers at t0-t7 indicate times of particular interest during the sequence.

The first plot from the top of FIG. 5 is a plot of air pump speed versus time. The vertical axis represents air pump speed and air pump speed increases in the direction of the vertical axis arrow. The horizontal axis represents time and time increases from the left side of the figure to the right side of the figure. Trace 502 represents the air pump speed.

The second first plot from the top of FIG. 5 is a plot of engine speed versus time. The vertical axis represents engine speed and engine speed increases in the direction of the vertical axis arrow. The horizontal axis represents time and time increases from the left side of the figure to the right side of the figure. Trace 504 represents the engine speed.

The third plot from the top of FIG. 5 is a plot of electric heater state versus time. The vertical axis represents electric heater state and the electric heater is activated when trace 506 is at a higher level near the vertical axis arrow. The horizontal axis represents time and time increases from the left side of the figure to the right side of the figure. Trace 506 represents the electric heater operating state.

The fourth plot from the top of FIG. 5 is a plot of fuel injector (e.g., 206 of FIG. 2) state versus time. The vertical axis represents fuel injector state and the fuel injector is activated (e.g., delivering fuel) when trace 508 is at a higher level near the vertical axis arrow. The horizontal axis represents time and time increases from the left side of the figure to the right side of the figure. Trace 508 represents the fuel injector state.

The fifth plot from the top of FIG. 5 is a plot of variable geometry turbocharger (VGT) state versus time. The vertical axis represents VGT state and VGT vanes are fully closed when trace 510 is near the horizontal axis. The horizontal axis represents time and time increases from the left side of the figure to the right side of the figure. Trace 510 represents the VGT operating state.

The sixth plot from the top of FIG. 5 is a plot of engine cold start preparation request (e.g., a request to prepare the engine for a cold start) versus time. The vertical axis represents the cold start preparation request state and an engine cold start preparation request is asserted when trace 512 is near the vertical axis arrow. An engine cold start preparation request is not asserted when trace 512 is near the horizontal axis. The horizontal axis represents time and time increases from the left side of the figure to the right side of the figure. Trace 512 represents the state of the engine cold start preparation request.

The seventh plot from the top of FIG. 5 is a plot of key on engine start request versus time. The vertical axis represents the key on engine start request state and the key on engine start request state is asserted when trace 514 is at a higher level that is near the vertical axis arrow. The horizontal axis represents time and time increases from the left side of the figure to the right side of the figure. Trace 514 represents the key on start request state.

The eighth plot from the top of FIG. 5 is a plot of passive NOx absorber (PNA) temperature versus time. The vertical axis represents PNA temperature and PNA temperature increases in the direction of the vertical axis arrow. The horizontal axis represents time and time increases from the left side of the figure to the right side of the figure. Dashed horizontal line 550 represents a first threshold PNA temperature. Horizontal line 552 represents a second threshold PNA temperature. Horizontal line 554 represents a third threshold PNA temperature. Dashed horizontal line 556 represents a fourth threshold PNA temperature. Trace 516 represents PNA temperature.

The ninth first plot from the top of FIG. 5 is a plot of catalyst temperature (e.g., a temperature of catalysts 71-73 of FIG. 1) versus time. The vertical axis represents catalyst temperature and catalyst temperature increases in the direction of the vertical axis arrow. The horizontal axis represents time and time increases from the left side of the figure to the right side of the figure. Dashed horizontal line 560 represents a catalyst light-off temperature. Trace 518 represents catalyst temperature.

At time t0, the engine is stopped (e.g., not rotating and combusting fuel) and engine speed is zero. The electric heater (e.g., 212 of FIG. 2), the combustor, and fuel injector are deactivated. The vanes of the VGT are fully closed and a cold engine start request is not asserted. The key on engine start request is not asserted and the passive NOx absorber (PNA) temperature is low. Catalyst temperature is below light-off temperature.

At the time t1, the engine remains stopped and engine speed is zero, but an engine cold start preparation request is asserted. An engine cold start preparation request may be made before a user (e.g., human or autonomous driver) requests the vehicle's engine to be started. The engine cold start preparation request may be generated via a key fob as a user approaches the vehicle, an internal timer scheduler in a controller of the vehicle, activity of the vehicle (e.g., opening of a vehicle door, etc.), a remote request that is generated via a phone or server, or other known means of communicating with a vehicle controller. The electric heater is activated in response to the engine cold start preparation request and the combustor remains off. The fuel injector is off and the VGT vanes are fully closed to prevent heating of the engine's exhaust manifold. The key on request is not activated and the PNA temperature remains low. The air pump (e.g., 202 of FIG. 2) is also activated and the three-way valve (e.g., 210 of FIG. 2) is positioned to allow air flow to the heater and prevent air flow through the bypass passage or conduit (e.g., 254) in response to the engine cold start preparation request. Activating the air pump and the heater allows heated air to warm the PNA or other after treatment device and after treatment devices that are further downstream from the PNA or after treatment device that follows the electric heater. Catalyst temperature begins to gradually increase.

At time t2, the PNA temperature reaches a first threshold temperature, which is represented by dashed horizontal line 550. At this temperature, the PNA may begin converting hydrocarbons and CO to $H_2O$ and $CO_2$. The PNA may also store NOx at this temperature. Therefore, the combustor is activated via supplying fuel via the fuel injector (e.g., 206 of FIG. 2). The air pump remains on and the VGT vanes remain fully closed. The engine cold start preparation request remains asserted and the key-on engine start request is not asserted. The combustor begins to heat the PNA and the PNA temperature begins to rise at a faster rate. The engine remains stopped. Catalyst temperature is below a light-off temperature.

At time t3, the PNA temperature reaches a second threshold temperature, which is represented by dashed horizontal line 552. The PNA continues to store NOx and convert hydrocarbons and CO at this temperature, but the temperature is approaching a temperature at which the PNA may release NOx. Therefore, the combustor is deactivated, but the air pump remains activated to continue heat transfer from the combustor to the PNA. The air pump speed is unchanged and the engine remains stopped. The electric heater remains off and the VGT vanes remains fully closed. The engine cold start preparation request remains asserted and the key-on engine start request is not asserted.

At time t4, the PNA temperature reaches a third threshold temperature, which is represented by dashed horizontal line 554. The PNA continues to store NOx and convert hydrocarbons and CO at this temperature, but the temperature is approaching a temperature at which the PNA may release NOx. The air pump speed is reduced at this temperature so that the PNA temperature may remain below the NOx release temperature of the PNA, which is indicated by dashed horizontal line 556. The engine remains stopped and the electric heater remains off. The VGT vanes remains fully closed and the engine cold start preparation request remains asserted. The key-on engine start request is not asserted. The PNA temperature begins to decline shortly after time t4. Catalyst temperature now exceeds light-off temperature.

At time t5, the PNA temperature falls to be less than the first threshold temperature without the key-on request being asserted, which is represented by dashed horizontal line 550. The PNA continues to store NOx and convert hydrocarbons and CO at this temperature. The combustor is reactivated by activating the fuel injector and the air pump speed is increased so that heat may be transferred more quickly from the combustor to the PNA. The VGT vanes remains fully closed and the engine cold start preparation request remains asserted. The key-on engine start request is not asserted. The PNA temperature begins to increase shortly after time t5.

At time t6, the key-on engine start request is asserted and the PNA or other after treatment device is prepared for engine start, so the temperature of the PNA may be increased to a temperature that is greater than a NOx release temperature for the PNA by activating the electric heater and maintaining combustor operation. For example, it may be determined whether the engine catalyst and/or SCR temperature are above threshold temperatures before the engine start is requested such that the engine start request may be asserted when catalyst/SCR temperature is above a threshold. Engine start may not be asserted when catalyst/SCR temperature is less than the threshold. In this example, the engine cold start preparation request is withdrawn and engine speed remains zero. The air pump speed may also be reduced to further increase the rate of PNA heating. The PNA is purged of NOx shortly after time t6 when the PNA temperature exceeds a fourth threshold (e.g., 556 of FIG. 5). By purging the NOx before the engine is started, a SCR or other device may reduce the NOx before the engine is started and additional NOx flows to the downstream after treatment devices.

At time t7, the engine is started and engine speed begins to increase. The air pump speed is increased to increase flow to downstream after treatment devices and the electric heater is shut off to conserve electrical energy. The combustor remains activated and the VGT vanes remain closed. The engine begins to supply heat energy to the after treatment devices and the three-way valve is positioned to flow gases from the combustor and air pump to downstream after treatment devices bypassing and preventing flow to the PNA.

Thus, a PNA or after treatment device that are arranged in parallel with an engine may provide heating to after treatment devices that are downstream of the engine and the PNA or after treatment device so that the downstream after treatment devices may be prepared to process exhaust gases from the engine when the engine is started. The electric heater may be activated before the combustor so that gases from the combustor may be processed when the combustor begins operation instead of after the combustor begins to operate. Activating the combustor may increase a heating rate of downstream after treatment devices so that an amount of time delay before the engine may be restarted may be reduced.

Referring now to FIG. 6, a method for operating an engine, a single combustor, and after treatment system of the types shown in FIGS. 1-3 is shown. The method of FIG. 6 may be at least partially implemented as executable instructions stored in memory of one or more controllers in the system of FIGS. 1-3. Further, the method of FIG. 6 may include actions taken in the physical world by a controller to transform an operating state of the system of FIGS. 1-3. Additionally, the method of FIG. 6 may provide at least portions of the operating sequence shown in FIG. 5.

At 602, method 600 judges whether or not there has been a request to warm engine after treatment devices (e.g., an engine cold start preparation request) and no engine start request. The request to warm after treatment devices may be made in response to a signal from an external device (e.g., server, phone, key fob, etc.), a timer internal to a controller, vehicle operating conditions (e.g., time of day, ambient temperature, etc.), or other means. If there is a request to warm engine after treatment devices (e.g., 71-73 of FIG. 1) and no engine start request, the answer is yes and method 600 proceeds to 640. Otherwise, the answer is no and method 600 proceeds to 604.

Thus, if method 600 selects "NO", pre-heating of engine after treatment devices (e.g., 71-73 of FIG. 4) prior to an engine start. This may occur if the after treatment devices are already at or above a desired temperature due to prior engine operation or pre-heating via the combustor or electric heater. If method 600 selects "YES", the after treatment devices may be heated via the electric heater and/or combustor when after treatment devices are relatively cold, such as prior to a cold start.

At 604, method 600 judges whether or not there is an engine start request. An engine start request may be generated via a human or autonomous driver providing input to a human/machine interface. If method 600 judges that there is an engine start request, the answer is yes and method 600 proceeds to 606. Otherwise, the answer is no and method 600 proceeds to exit.

At 606, method 600 may activate an air pump (e.g., 202 of FIG. 2) and adjust a position of a three-way valve (e.g., 210 of FIG. 2) so that flow from the air pump passes through an electric heater (e.g., 212 of FIG. 2) and an after treatment device (e.g., a PNA). Method 600 increases a temperature of the PNA or after treatment device to a fourth threshold (e.g., Tsp4) to release NOx from the PNA or after treatment device. This is permitted because the catalyst temperature is above threshold temperature 260. The PNA or after treatment device may be positioned along the passage or conduit 252. Method 600 proceeds to 608.

At 608, method 600 judges whether or not NOx is purged from the PNA or after treatment device that is located downstream of the electric heater. In one example, method 600 may judge that the NOx is purged when temperature of the PNA or after treatment device is greater than the fourth threshold for longer than a predetermined amount of time. If method 600 judges that the PNA or after treatment device is purged of NOx, the answer is yes and method 600 proceeds to 610. Otherwise, the answer is no and method 600 returns to 606.

At 610, method 600 turns the combustor (e.g., 208 of FIG. 2) on by supplying fuel to the combustor. Method 600 also shuts down the electric heater to conserve electrical energy. Method 600 proceeds to 612.

At 612, method 600 judges whether a temperature of a first engine after treatment device (e.g., 71 of FIG. 1) is less than a fifth threshold temperature. If so, the answer is yes and method 600 proceeds to 613. If not, the answer is no and method 600 proceeds to 614.

At 613, method 600 activates the combustor by supplying fuel to the combustor via the fuel injector. Method 600 proceeds to 614.

At 614, method 600 judges whether a temperature of a first engine after treatment device (e.g., 71 of FIG. 1) is greater than a sixth threshold temperature. If so, the answer is yes and method 600 proceeds to 615. If not, the answer is no and method 600 proceeds to 616.

At 615, method 600 deactivates the combustor by stopping fuel flow to the combustor via the fuel injector. Method 600 proceeds to 616.

At 616, method 600 judges whether a temperature of a first engine after treatment device (e.g., 71 of FIG. 1) is greater than a seventh threshold temperature. If so, the answer is yes and method 600 proceeds to 618. If not, the answer is no and method 600 returns to 612.

At 618, method 600 deactivates the combustor by stopping fuel flow to the combustor via the fuel injector. Method 600 proceeds to exit.

At step 640, method 600 judges whether or not a combustion after treatment device (e.g., a PNA) temperature is less than a first threshold temperature Tsp1. If so, the answer is yes and method 600 proceeds to 642. Otherwise, the answer is no and method 600 proceeds to 644.

At 642, method 600 adjusts a position of the three-way valve (e.g., 210 of FIG. 2) to direct air flow from the air pump (e.g., 202 of FIG. 2) to combustor after treatment devices (e.g., 214 and 216 of FIG. 2). Method 600 also activates the air pump and electric heater. The combustor is turned off by not flowing fuel through the fuel injector (e.g., 206 of FIG. 2) and VGT vanes are fully closed to prevent heating of the exhaust manifold via the electric heater. These actions allow the electric heater to heat the PNA. Method 600 proceeds to 644.

At step 644, method 600 judges whether or not a combustion after treatment device (e.g., a PNA) temperature is greater than the first threshold temperature Tsp1. If so, the answer is yes and method 600 proceeds to 646. Otherwise, the answer is no and method 600 returns to 642.

At 646, method 600 adjusts a position of the three-way valve (e.g., 210 of FIG. 2) to direct air flow from the air pump (e.g., 202 of FIG. 2) to combustor after treatment devices (e.g., 214 and 216 of FIG. 2). Method 600 also activates the air pump and shuts the electric heater off. The combustor is turned on by flowing fuel through the fuel injector (e.g., 206 of FIG. 2) and VGT vanes are fully closed to prevent heating of the exhaust manifold via the electric heater. These actions allow the combustor to heat the PNA and conserve electric power. Method 600 proceeds to 648.

At step 648, method 600 judges whether or not a combustion after treatment device (e.g., a PNA) temperature is greater than the second threshold temperature Tsp2. If so, the answer is yes and method 600 proceeds to 650. Otherwise, the answer is no and method 600 returns to 646.

At 650, method 600 adjusts a position of the three-way valve (e.g., 210 of FIG. 2) to direct air flow from the air pump (e.g., 202 of FIG. 2) to combustor after treatment devices (e.g., 214 and 216 of FIG. 2). Method 600 also activates the air pump and shuts the electric heater off. The combustor is turned off by not flowing fuel through the fuel injector (e.g., 206 of FIG. 2) and VGT vanes are fully closed to prevent heating of the exhaust manifold via the electric heater. These actions allow air to be heated by the warmed combustor without consuming additional fuel and heat the PNA. Method 600 proceeds to 652.

At step 652, method 600 judges whether or not a combustion after treatment device (e.g., a PNA) temperature is greater than the third threshold temperature Tsp3. If so, the answer is yes and method 600 proceeds to 654. Otherwise, the answer is no and method 600 returns to 650.

At 654, method 600 adjusts a position of the three-way valve (e.g., 210 of FIG. 2) to direct air flow from the air pump (e.g., 202 of FIG. 2) to combustor after treatment devices (e.g., 214 and 216 of FIG. 2). Method 600 also may reduce air pump speed and shuts the electric heater off. The combustor is turned off by not flowing fuel through the fuel injector (e.g., 206 of FIG. 2) and VGT vanes are fully closed to prevent heating of the exhaust manifold via the electric heater. These actions allow less heated air to reach the PNA so that PNA temperature may be limited to less than a NOx release temperature of the PNA. Method 600 proceeds to 656.

At step 656, method 600 judges whether or not a combustion after treatment device (e.g., a PNA) temperature is less than the first threshold temperature Tsp1. If so, the answer is yes and method 600 returns to 602. Otherwise, the answer is no and method 600 returns to 654. These actions allow the combustor to be reactivated when PNA temperature falls due to the combustor being deactivated. Thus, the combustor may be cycled on and off to heat the PNA and conserve fuel without releasing NOx before the engine is cranked and started.

Thus, method 600 provides heat to a combustor after treatment device so that the combustor after treatment device may process combustor gases. Once the combustor after treatment device is at operating temperature, the combustor is activated to heat engine after treatment devices at a rate that is greater than the heater could heat the engine after treatment devices. The combustor may be deactivated to reduce the possibility of NOx release by the PNA. Once the engine after treatment devices are up to operating temperature (e.g., a light-off temperature), the engine may be started.

Referring now to FIG. 7, a method for operating an engine, two combustors, and after treatment system of the types shown in FIGS. 1 and 4 is shown. The methods of FIG. 7 may be at least partially implemented as executable instructions stored in memory of one or more controllers in the system of FIGS. 1 and 4. Further, the method of FIG. 7 may include actions taken in the physical world by a controller to transform an operating state of the system of FIGS. 1 and 4.

At 702, method 700 judges whether or not there has been a request to warm engine after treatment devices (e.g., an engine cold start preparation request) and no engine start request. The request to warm after treatment devices may be made in response to a signal from an external device (e.g., server, phone, key fob, etc.), a timer internal to a controller, vehicle operating conditions (e.g., time of day, ambient temperature, etc.), or other means. If there is a request to warm engine after treatment devices (e.g., 71-73 of FIG. 1) and no engine start request, the answer is yes and method 700 proceeds to 704. Otherwise, the answer is no and method 700 proceeds to 710.

At 710, method 700 judges whether or not the engine after treatment device temperature is less than a threshold temperature. If so, the answer is yes and method 700 proceeds to 712. In some examples, method 700 may also require that the engine is requested to be started and/or operating (e.g., rotating and combusting fuel).

At 712, method 700 activates a second combustor (e.g., 408 of FIG. 4) and deactivates a first combustor (e.g., 208 of FIG. 4). The second combustor is activated by injecting fuel into the second combustor via a fuel injector. The first combustor is deactivated by ceasing fuel flow to the first combustor. Method 700 proceeds to 714.

At 714, method 700 activates a second air pump (e.g., 402 of FIG. 4) and deactivates a first air pump (e.g., 202 of FIG. 4). The second air pump is activated to provide heat to the engine after treatment devices without heating the combustor after treatment devices so that the engine after treatment devices may reach a higher temperature. Method 700 proceeds to exit.

At 720, method 700 deactivates the second combustor (e.g., 408 of FIG. 4) and deactivates the first combustor (e.g., 208 of FIG. 4). The second combustor is deactivated by preventing injection of fuel into the second combustor via a fuel injector. The first combustor is deactivated by ceasing fuel flow to the first combustor. Method 700 proceeds to 722.

At 722, method 700 deactivates the second air pump (e.g., 402 of FIG. 4) and deactivates the first air pump (e.g., 202 of FIG. 4). Method 700 proceeds to exit.

At 704, method 700 activates the combustor (e.g., 208 of FIG. 4) and activates the second combustor (e.g., 408 of FIG. 4). The first combustor is activated by injecting fuel into the first combustor via a fuel injector. The second combustor is deactivated by ceasing fuel flow to the second combustor. The first combustor is activated to activate the combustor after treatment devices and to heat engine after treatment devices while processing combustor output gases. Method 700 proceeds to 706.

At 706, method 700 activates the first air pump (e.g., 202 of FIG. 4) and deactivates the second air pump (e.g., 402 of FIG. 4). The first air pump is activated to provide heat to the combustor after treatment devices to process combustor output gases. The second air pump is deactivated so that output of the second combustor is suppressed until the engine after treatment devices have reached a light off temperature. Method 700 proceeds to 708.

At 708, method 700 judges whether or not engine after treatment device temperature has reached a threshold temperature (e.g., light-off temperature). If so, the answer is yes and method 700 proceeds to exit. The combustors and air pumps may be deactivated when the engine after treatment devices exceed the threshold temperature. If not, the answer is no and method 700 returns to 704.

Thus, method 700 may operate two combustors during different operating conditions to balance emissions and heat delivery to engine after treatment devices. The second combustor may be activated after the first combustor has heated engine after treatment devices to conditions where the engine after treatment devices may process gases from the second combustor. The second combustor may increase heat delivery to the engine after treatment devices as compared to the first combustor.

Thus, the methods of FIGS. 6 and 7 provide for an engine operating method, comprising: activating an electric heater located in a passage downstream of a combustor via a controller in response to a request to prepare an engine for cold start while rotational speed of the engine is zero; and adjusting a position of a three-way valve via the controller to permit flow from an air pump to the electric heater and prevent flow from the air pump to a second passage, the second passage arranged in parallel to the passage. In a first example, the engine operating method further comprises providing flow from the air pump to a passive NOx absorber, the passive NOx absorber positioned along the second passage and downstream of the electric heater. In a second example that may include the first example, the engine operating method further comprises fully closing vanes of a variable geometry turbocharger via the controller. In a third example that may include one or both of the first and second examples, the engine operating method further comprises not injecting fuel to the combustor via a fuel injector that is configured to inject fuel to the combustor. In a fourth example that may include one or more of the first through third examples, the engine operating method further comprises injecting fuel to the combustor via the controller in response to a temperature of a passive NOx absorber exceeding a threshold temperature. In a fifth example that may include one or more of the first through fourth examples, the engine operating method further comprises increasing a temperature of a passive NOx absorber via increasing an amount of fuel injected to the combustor, reducing air flow to supplied to the combustor, or activating the electric heater when the temperature of the passive NOx absorber is greater than a first threshold temperature so as to purge NOx from the passive NOx absorber. In a sixth example that may include one or more of the first through fifth examples, the engine operating method further comprises adjusting a position of the three-way valve to prevent flow from the air pump to the electric heater and allow flow to bypass the electric heater in response to purging NOx from the passive NOx absorber. Additionally, the three-way valve position may be adjusted to prevent flow from the air pump to the electric heater when the after treatment devices have reached a threshold temperature (e.g., light-off temperature), when higher after treatment temperatures may be desired. In yet another example, bypass valve 306 may be opened to limit or lower temperatures at inlets of 212-216 when combustor 208 is activated.

Note that the example control and estimation routines included herein can be used with various engine and/or vehicle system configurations. The control methods and routines disclosed herein may be stored as executable instructions in non-transitory memory and may be carried out by the control system including the controller in combination with the various sensors, actuators, and other engine hardware. Further, portions of the methods may be physical actions taken in the real world to change a state of a device. The specific routines described herein may represent one or more of any number of processing strategies such as event-driven, interrupt-driven, multi-tasking, multi-threading, and the like. As such, various actions, operations, and/or functions illustrated may be performed in the sequence illustrated, in parallel, or in some cases omitted. Likewise, the order of processing is not necessarily required to achieve the features and advantages of the example examples described herein, but is provided for ease of illustration and description. One or more of the illustrated actions, operations and/or functions may be repeatedly performed depending on the particular strategy being used. Further, the described actions, operations and/or functions may graphically represent code to be programmed into non-transitory memory of the computer readable storage medium in the engine control system, where the described actions are carried out by executing the instructions in a system including the various engine hardware components in combination with the electronic controller. One or more of the method steps described herein may be omitted if desired.

It will be appreciated that the configurations and routines disclosed herein are exemplary in nature, and that these specific examples are not to be considered in a limiting sense, because numerous variations are possible. For example, the above technology can be applied to V-6, I-4, I-6, V-12, opposed 4, and other engine types. The subject matter of the present disclosure includes all novel and non-obvious combinations and sub-combinations of the various systems and configurations, and other features, functions, and/or properties disclosed herein.

The following claims particularly point out certain combinations and sub-combinations regarded as novel and non-obvious. These claims may refer to "an" element or "a first" element or the equivalent thereof. Such claims may be understood to include incorporation of one or more such elements, neither requiring nor excluding two or more such elements. Other combinations and sub-combinations of the disclosed features, functions, elements, and/or properties may be claimed through amendment of the present claims or through presentation of new claims in this or a related application. Such claims, whether broader, narrower, equal, or different in scope to the original claims, also are regarded as included within the subject matter of the present disclosure.

The invention claimed is:

1. An exhaust system for an internal combustion engine, comprising:

an air pump supplying air to a combustor located along a first passage;

a three-way valve positioned downstream of the combustor along the first passage;

an electric heater positioned along a second passage downstream of the three-way valve;

a third passage arranged in parallel with the second passage, the third passage coupled to the second passage and entering a fourth passage, and the fourth passage extending to an exhaust passage and positioned upstream of a group of after treatment devices in the exhaust passage;

a check valve positioned along the first passage; and an oxidation catalyst located along the second passage downstream of the electric heater.

2. The exhaust system of claim 1, where the fourth passage is coupled to the exhaust passage downstream of a turbocharger.

3. The exhaust system of claim 1, where the check valve is configured to allow flow from the air pump to the combustor and prevent flow from the combustor to the air pump.

4. The exhaust system of claim 1, further comprising a passive NOx absorber located along the second passage downstream of the electric heater.

5. The exhaust system of claim 1, where the fourth passage extends to the exhaust passage at a location downstream of a turbocharger turbine.

6. The exhaust system of claim 1, further comprising a variable geometry turbocharger and a controller, the controller including executable instructions stored in non-transitory memory that cause the controller to activate the air pump, activate the electric heater, and adjust an operating state of the three-way valve.

7. The exhaust system of claim 6, further comprising executable instructions that cause the controller to:

activate the air pump, fully close the variable geometry turbocharger, and activate the electric heater in response to an engine cold start preparation request while rotational speed of the internal combustion engine is zero.

8. The exhaust system of claim 6, where the instructions to adjust the operating state of the three-way valve further include instructions to adjust a position of the three-way valve via the controller to permit flow from the air pump to the electric heater and prevent flow from the air pump to the second passage.

9. The exhaust system of claim 8, further comprising instructions for fully closing vanes of the variable geometry turbocharger via the controller.

10. The exhaust system of claim 8, further comprising instructions for not injecting fuel to the combustor via a fuel injector that is configured to inject fuel to the combustor.

11. The exhaust system of claim 8, further comprising instructions for injecting fuel to the combustor via the controller in response to a temperature exceeding a threshold temperature.

12. An exhaust system for an internal combustion engine, comprising:

an air pump supplying air to a combustor located along a first passage;

a three-way valve positioned downstream of the combustor along the first passage;

an electric heater positioned along a second passage downstream of the three-way valve;

an oxidation catalyst and a lean NOx trap arranged along the second passage;

a third passage arranged in parallel with the second passage, the third passage coupled to the second passage and entering a fourth passage, and the fourth passage extending to an exhaust passage and positioned upstream of a group of after treatment devices in the exhaust passage; and a bypass passage arranged in parallel with the first passage and in series with the second passage and the third passage.

13. The exhaust system of claim 12, further comprising a second combustor, the second combustor arranged in parallel with the first passage, the second passage, and the third passage.

14. The exhaust system of claim 12, further comprising a fuel injector configured to inject fuel to the combustor.

15. The exhaust system of claim 14, further comprising a second combustor arranged in parallel with the combustor and a second fuel injector configured to inject fuel to the second combustor.

* * * * *